United States Patent [19]

Dätwyler

[11] 4,157,067

[45] Jun. 5, 1979

[54] FORM CYLINDER PROVIDED WITH FLEXIBLE PRINTING PLATES FOR ROTARY INTAGLIO PRINTING PRESSES

[75] Inventor: Max Dätwyler, Bleienbach, Switzerland

[73] Assignee: Firma Max Daetwyler & Co., Switzerland

[21] Appl. No.: 881,543

[22] Filed: Feb. 27, 1978

[30] Foreign Application Priority Data

Feb. 28, 1977 [SE] Sweden ..... 7702198

[51] Int. Cl.[2] ..... B41F 27/06; B41F 7/22

[52] U.S. Cl. ..... 101/415.1

[58] Field of Search ..... 101/415.1, 378

[56] References Cited

U.S. PATENT DOCUMENTS

| | | | |
|---|---|---|---|
| 1,049,195 | 12/1912 | Banzett | 101/415.1 |
| 1,275,877 | 8/1918 | Drange | 101/415.1 |
| 1,795,700 | 3/1931 | Baldwin | 101/415.1 |
| 1,996,348 | 4/1935 | Robinson | 101/415.1 |
| 2,474,127 | 6/1949 | Tollison et al. | 101/378 |
| 2,775,198 | 12/1956 | Johnson et al. | 101/415.1 |
| 2,953,091 | 9/1960 | Luehrs | 101/415.1 |
| 2,987,994 | 6/1961 | Allison | 101/375 |
| 3,230,883 | 1/1966 | Achiner et al. | 101/415.1 |
| 3,490,369 | 1/1970 | Huck | 101/378 |

FOREIGN PATENT DOCUMENTS

| | | | |
|---|---|---|---|
| 617936 | 8/1935 | Fed. Rep. of Germany | 101/415.1 |
| 1092035 | 11/1960 | Fed. Rep. of Germany | 101/378 |
| 553002 | 5/1923 | France | 101/415.1 |
| 1044012 | 11/1953 | France | 101/415.1 |
| 1115946 | 5/1956 | France | 101/415.1 |
| 296395 | 5/1932 | Italy. | |
| 146573 | 4/1931 | Switzerland | 101/415.1 |
| 840586 | 7/1960 | United Kingdom | 101/415.1 |

*Primary Examiner*—J. Reed Fisher

*Attorney, Agent, or Firm*—McGlew and Tuttle

[57] ABSTRACT

A form cylinder for rotary intaglio printing presses comprises first and second half cylindrical parts which are joined together to form a cylinder having diametrically opposite recesses and with each part having a facing side facing the respective other cylinder part with a clamping device recess defined therein. At least one flexible printing plate extends over each cylindrical part and is connected at each end to a profile piece in the form of an angle member which is displaceably positioned in each respective recess. A clamping mechanism in the form of a toggle is provided in the recess of the cylindrical part and it includes a drive member for actuating the toggle to displace the profiled member to effect tensioning of each printing plate both in tangential and radial directions.

10 Claims, 10 Drawing Figures

33'
33
6'
2a 4
6
7
50
9
8
7
19
20
17b
18
2
3
17a
11'
11
16
13
17

11
33
31
34
14
30
12

19
22
21

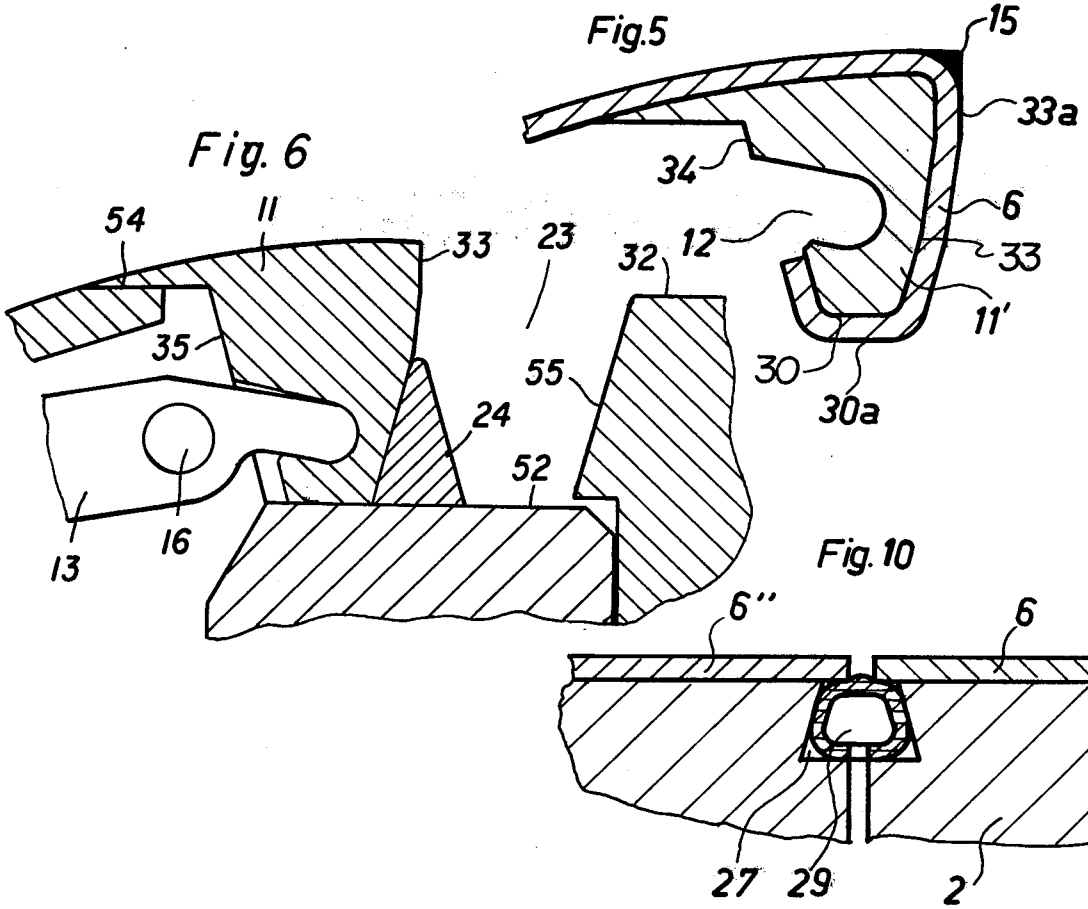
Fig.5
15
33a
6
33
11'
30a
30
34
12
32
23
55
52
24
33
Fig. 6
11
35
54
16
13
Fig. 10
6
2
29
27
6''
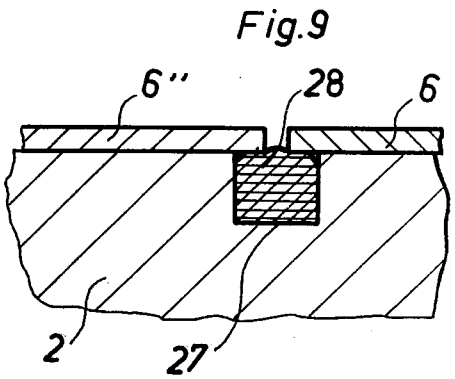
Fig.9
6
28
27
6''
2

FORM CYLINDER PROVIDED WITH FLEXIBLE PRINTING PLATES FOR ROTARY INTAGLIO PRINTING PRESSES

BACKGROUND OF THE INVENTION

1. Field of the Invention

The invention relates in general to printing machines and in particular to a new and useful form cylinder for rotary intaglio printing presses provided with flexible printing plates.

2. Description of the Prior Art

The problem of equipping form cylinders for intaglio printing presses with flexible printing plates has been known for a long time. Care must be taken that the flexible printing plates are clamped tightly and uniformly on the cylinder body, and that the butt joint is closed completely so that no ink can be deposited therein and the wiper can slide smoothly over it.

Several solutions are known as attempts to meet these requirements:

German Patent No. 541,478 shows a device for clamping flexible printing plates on the form cylinder of intaglio printing presses where the bent-off ends of the printing plates are held in clamping strips and stressed by means of a wedge both in radial and in tangential directions. This device is only suitable for form cylinders which have the width of the printing plates, and it has a disadvantage that the form cylinder must be removed from the machine to change the printing plates, since the clamping strips and the wedge can only be introduced into the dovetailed grooves at the front end.

It is already known from German Patent No. 567,546 that the ends of the printing plates cannot be bent off so sharply that no interwall receiving ink is formed at the plate butt. This fact is taken into consideration by pressing the ends of the printing plates against a filler, which is subsequently smoothed and hardened on the outer surface. This procedure is cumbercome and time consuming, just like the casting of the plate butt, as it is known from DOS 24 09 456 and German design patent No. 75 25 069.

SUMMARY OF THE INVENTION

The invention provides a form cylinder for rotary intaglio printing presses with fitting, flexible printing plates where the printing plates can be changed individually without having to remove the form cylinder, and where the printing plate butt closes completely mechanically. This problem is solved according to the invention in this way that at least two cylinder parts forming the form cylinder are firmly joined with each other and centered and secured each at the front end on a flange, and that a clamping device is installed in each cylinder part for each printing plate to be clamped on, with which the two ends of the printing plate which are provided undetachably with a profiled piece, can be stressed simultaneously both in tangential and in radial directions.

Accordingly it is an object of the invention to provide a form cylinder which comprises first and second half cylindrical parts joined together to form a cylinder with diametrically opposite recesses on its periphery at the location of the junctures of the two half cylindrical parts, each half cylindrical part having a side facing the other with a recess therein containing a clamping device connected to a profile piece attached to each end of a flexible printing plate stretched over each cylindrical part, the clamping means being actuable to displace the profile piece to tension each printing plate both in tangential and radial directions.

A further object of the invention is to provide a form cylinder which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the Drawings:

FIG. 5 is a view similar to FIG. 4 indicating the attachment of a printing plate to the profiled piece;

FIG. 6 is a view similar to FIG. 5 indicating the profiled piece in position in a recess of the form cylinder;

FIG. 9 is a view similar to FIG. 7 of still another embodiment of the invention; and FIG. 10 is a view similar to FIG. 7 of still another embodiment of the invention.

GENERAL DESCRIPTION OF THE PREFERRED EMBODIMENTS

Figure 1:
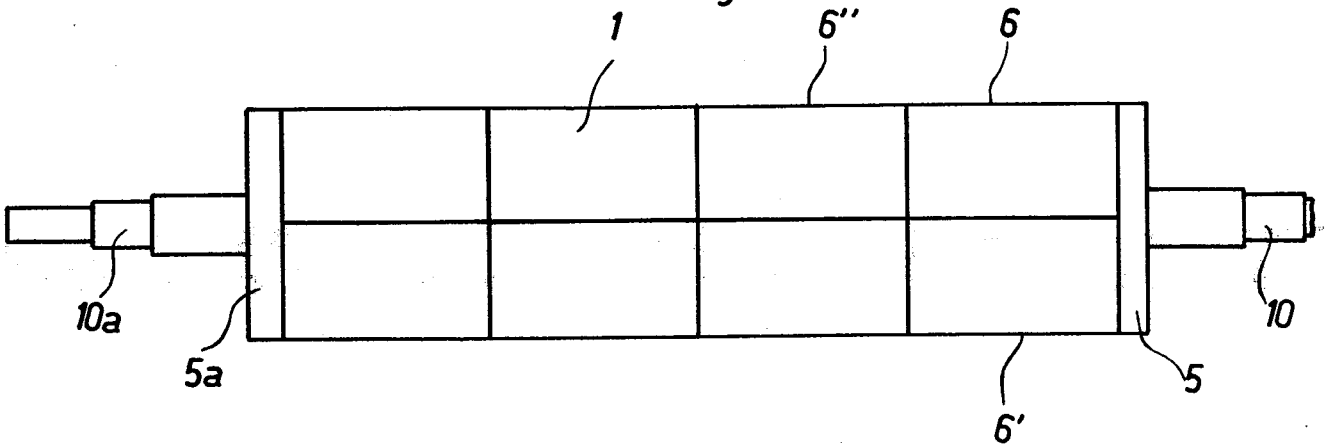
FIG. 1 is a side elevational view of a form cylinder having clamped on printing plates constructed in accordance with the invention.

Referring to the drawings in particular, the invention embodied therein comprises the construction of a form cylinder 1 which is longitudinally divided and made up of two half cylindrical parts 2*a* and 2 which when they are fitted together form the cylinder and define a recess therein for a toggle mechanism or clamping device generally designated 50.

The form cylinder 1 is formed by assembly of at least two cylinder parts 2, 2*a* which are assembled at butt joints by means of L-shaped fitting surfaces 3 and bolted, for example with screws 4. The entire form cylinder 1 is centered at the front in known manner, not specifically represented, on a flange 5*a*, and thus firmly connected.

An advantageous design of the cylinder parts is that they are completely equal, hence identical.

In the cylinder parts 2, 2*a* is provided for each printing plate 6 to be clamped on clamping means comprising a clamping device 50, which is actuated by at least one fluid pressure piston and cylinder combination 7. The piston and cylinder combination 7 includes a piston rod 7*a* secured to a head piece 9 of the device 50. The lines for the pressure medium to the combination 7 are conducted in a known manner (not shown) through a bearing pin 10 or 10*a* of one of two end flanges 5 or 5*a* of the form cylinder.

A flexible printing plate 6 is undetachably connected at both ends with a profiled piece or angle member 11, which has a pawl receiving groove or recess 12 (FIGS. 5 and 6) into which the engaging part of pawl 13 is received.

FIG. 5 shows a design of printing plate 6' where each end of each of the printing plates 6, 6' is conducted around the associated cylinder part 2, 2a and is undetachably connected with a profiled piece 11, 11', for example, by gluing. In order to achieve in this design a complete closing of the printing plate butt, printing plate 6 is metal-faced in a known manner on the outside of a bend 15 and is machine-finished. Each profile piece 11 and 11' has a first leg portion secured to an associated plate 2 or 2a and a second leg portion provided with a pawl engagement recess 12.

Pawl 13 is pivotally mounted on a bolt 16 arranged in a cylinder part 2, 2a and jointed with head piece 9 of the clamping device 50 over a first toggle lever 17 and a second toggle lever 18, which is supported in a bearing piece 19, by means of a tie rod 20 which is pivoted to head piece 9. A similar toggle lever system for the opposite end of printing plate 6 is also connected between the head piece 9 and the profiled piece 11 or 11' connected to the opposite end of plate 6.

The first toggle lever 17 is advantageously designed as a two-part linkage 17a, 17b which is under spring action, and bearing piece 19 is advantageously provided with a flexible part 22, which is under the load of a spring element 21, so that the plate tension is not reduced when the toggle lever system is turned somewhat beyond the dead center position for self-locking. Either the first toggle lever 17 or bearing piece 19 or both together are made resilient, depending on the magnitude of the desired pressure.

Each cylinder part 2, 2a is provided with a recess 23, necessary for the introduction of the profiled piece 11, which is bounded by a bottom 52 on which is arranged a stop piece 24 and the second leg portion of each profiled piece 11 and 11' engages against the bottom 52.

Figure 7:
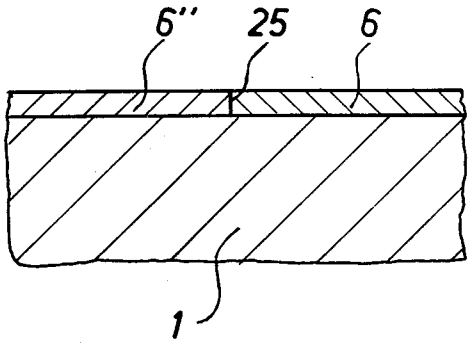
FIG. 7 is a section through a lateral printing plate butt.
Figure 8:
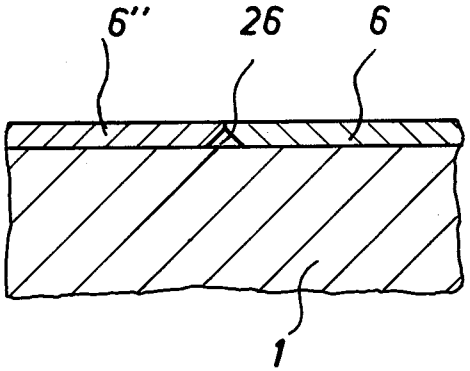
FIG. 8 is a view similar to FIG. 7 of another embodiment of plate butt.
Figure 2:
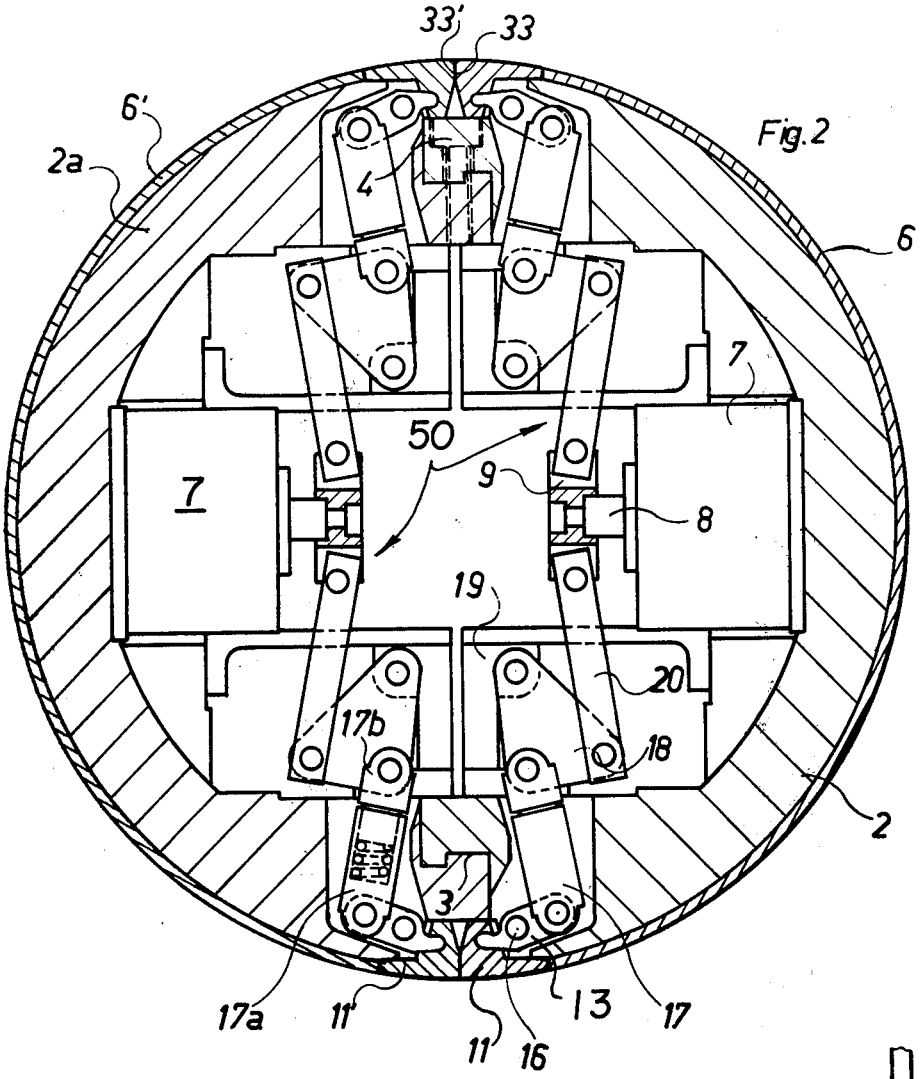
FIG. 2 is an enlarged sectional view through the form cylinder of FIG. 1.
Figure 4:
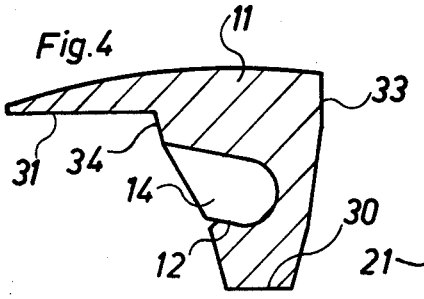
FIG. 4 is a section through a profiled piece used in the mechanism shown in FIG. 1.
Figure 3:
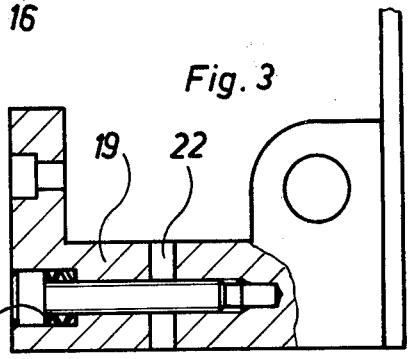
FIG. 3 is a sectional view of a bearing piece for the support of the toggle mechanism shown in FIG. 2.

For the lateral joining of two or more printing plates, each printing plate 6 and 6' is provided on the length side either with sealing surface 25 (FIG. 7) or it is so profiled that a cavity 26 (FIG. 8) is formed which is suitable to receive a seal.

Another possibility for sealing the printing plate butt consists in providing in cylinder part 2, 2a at each point of the end of an associated printing plate a groove 27 (FIG. 9) into which a correspondingly profiled seal 28 or a tubular seal 29 (FIG. 10) is inserted, which latter can be connected in known manner with a controllable pressure system for inflating the seal 29.

Printing plate 6 to be clamped is attached to the form cylinder 2 after the angle members 11 are lifted by the pawls 13 with piston rod 8 extended. Upon the retroaction of piston rod 8, pawls 13 are so turned by the associated toggle lever linkage that each profiled piece 11 is pressed radially with its base 30 of its second leg portion against the bottom 52 of recess 23 and with a tangential supporting surface 31 of the first leg portion against a first counter-surface 54 on the cylinder part. Also in the secured position the sealing surface 33 of angle member 11 bears against sealing surface 33' of angle member 11' of an opposite printing plate 6'. A shoulder 34 also bears on a second counter-surface 55 on the cylinder part.

In the embodiment according to FIG. 5, base 30 and sealing surface 33 are arranged logically on the corresponding bent parts 30a, 33a of the printing plate 6.

Canting of two adjacent profiled pieces 11 against each other is prevented by the stop piece 24, due to which it is also possible to change individual printing plates without having to remove the opposite printing plate.

While specific embodiments of the invention have been shown and described in detail to illustrate the application of the principles of the invention, it will be understood that the invention may be embodied otherwise without departing from such principles.

What is claimed is:

1. A form cylinder comprising first and second half cylindrical parts joined together to form a cylinder with an intermediate clamping mechanism receiving recess defined between said first and second half cylindrical parts and with diametrically opposite end recesses formed therebetween adjacent ones of said half cylindrical parts, each of said end recesses having a bottom surface defined by said half cylindrical parts, first and second flexible printing plates extending over respective first and second half cylindrical parts, first and second angle members for each printing plate, each having a first leg portion adapted to be connected to a respective end of each of said printing plates, and a second leg portion adapted to be supported on said bottom surface of each respective diametrically opposite end recess when in a clamping position, and clamping means disposed in an intermediate clamping mechanism receiving recess and comprising respective first and second driving piston and cylinder combinations for each of the respective first and second printing plates, a first toggle linkage connected between respective first and second piston and cylinder combinations and a respective first angle member of each plate and a second toggle linkage connected between the respective first and second piston and cylinder combinations and said second angle member of each plate, said first and second driving piston and cylinder combinations being effective to displace respective first and second angle members in a direction away from the associated end of the first and second printing plates to which they are attached in order to tension said printing plate and to engage said second leg portion on the associated bottom surface of each diametrically opposite end recess.

2. A form cylinder according to claim 1 wherein said half cylindrical parts are substantially identical.

3. A form cylinder according to claim 1 wherein said clamping means includes a pawl, means mounting said pawl for pivotal movement in the end recess adjacent each first and second angle members, said first and second angle members having a groove therein into which said pawl is engageable.

4. A form cylinder according to claim 1 wherein said toggle linkage comprises a two part linkage, and means for putting said two-part linkage under spring tension.

5. A form cylinder according to claim 1 wherein each end of said printing plate is bent around said angle member, each of said printing plates having a metal face machined to form a full edge sealing surface which is disposed at the periphery of said plate.

6. A form cylinder according to claim 1 wherein said angle member first leg portion has a curved tangential portion facing the associated one of said first and second cylindrical parts and defines a sealing surface with the associated one of said first and second cylindrical parts, said second leg portion having a counter surface on the side thereof opposite from said tangential surfaces which bears against the adjacent angle member of the other of said printing plates.

7. A form cylinder according to claim 1, including at least one stop piece centered on said bottom surface and providing a stop for the movement of said angle member on each side thereof in a circumferential direction.

8. A form cylinder according to claim 1, wherein each of said half cylindrical parts includes abutting surfaces defining a gap therebetween, and a seal disposed in said gap and abutting against each respective plate.

9. A form cylinder according to claim 8, wherein said seal comprises a hollow tube.

10. A form cylinder according to claim 9, wherein said hollow tube is inflatable.

* * * * *